US009616280B2

(12) United States Patent
Chuang

(10) Patent No.: US 9,616,280 B2
(45) **Date of Patent: *Apr. 11, 2017**

(54) SITTING TYPE OBLONG ORBITAL EXERCISING MACHINE

(71) Applicant: HIGH SPOT HEALTH TECHNOLOGY CO., LTD., Taichung (TW)

(72) Inventor: Yen-Chi Chuang, Taichung (TW)

(73) Assignee: High Spot Health Technology Co., Ltd., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/957,757

(22) Filed: Dec. 3, 2015

(65) Prior Publication Data

US 2016/0296790 A1 Oct. 13, 2016

(30) Foreign Application Priority Data

Apr. 13, 2015 (TW) ..... 104205485 U

(51) Int. Cl.
*A63B 22/12* (2006.01)
*A63B 22/06* (2006.01)
(Continued)

(52) U.S. Cl.
CPC ..... *A63B 22/0605* (2013.01); *A63B 22/001* (2013.01); *A63B 22/0015* (2013.01);
(Continued)

(58) Field of Classification Search
CPC . A63B 22/0002–22/0012; A63B 22/20; A63B 22/201; A63B 22/203; A63B 22/0664; A63B 22/0605; A63B 23/03516; A63B 23/03533; A63B 23/03575; A63B 23/03583; A63B 23/03591; A63B 23/04–23/0429; A63B 23/12; A63B 23/1209; A63B 23/1245; A63B 23/1263; A63B 23/1281; A63B 2022/067; A63B 2022/0676;
(Continued)

(56) References Cited

U.S. PATENT DOCUMENTS 6,932,745 B1 * 8/2005 Ellis ..... A63B 22/0023 482/52
7,276,017 B2 * 10/2007 Chen ..... A63B 22/001 482/52
(Continued)

*Primary Examiner* — Loan H Thanh
*Assistant Examiner* — Gregory Winter
(74) *Attorney, Agent, or Firm* — Alan D. Kamrath; Kamrath IP Lawfirm, P.A.

(57) ABSTRACT

An oblong orbital exercising machine includes a main frame, an upright, a seat support, a cycle movement mechanism, two swinging handles, two drive bars, two pedal units and two adjustment units. Each of the pedal units includes a fixing plate, a rocking plate, two springs, two fastening rods and a pedal. Each of the two adjustment units includes a fixed disk, an adjusting disk, two limit stubs, a hollow rod, a hollow mounting sleeve and a positioning pull pin. Thus, when the pedal units are moved in concert with the drive bars, the pedal of each of the pedal units is adjusted to correspond to the oblong trace of movement. In addition, the user can adjust the position of each of the pedal units easily and quickly by operation of each of the two adjustment units.

6 Claims, 12 Drawing Sheets

(51) Int. Cl.

| | |
|---|---|
| *A63B 21/02* | (2006.01) |
| *A63B 22/00* | (2006.01) |
| *A63B 71/00* | (2006.01) |
| *A63B 22/20* | (2006.01) |

(52) U.S. Cl.
CPC ..... *A63B 22/0664* (2013.01); *A63B 21/023* (2013.01); *A63B 22/0069* (2013.01); *A63B 22/205* (2013.01); *A63B 2071/0063* (2013.01); *A63B 2208/0238* (2013.01)

(58) Field of Classification Search
CPC .... A63B 2022/0682; A63B 2022/0688; A63B 2023/0441; A63B 2023/0447; A63B 2023/0452
See application file for complete search history.

(56) References Cited

U.S. PATENT DOCUMENTS

| | | | | |
|---|---|---|---|---|
| 8,998,775 | B1 * | 4/2015 | Chuang | A63B 22/0664 482/51 |
| 9,067,101 | B1 * | 6/2015 | Chuang | A63B 22/0664 |
| 2004/0259692 | A1 * | 12/2004 | Martin | A63B 22/0007 482/52 |
| 2005/0003932 | A1 * | 1/2005 | Chen | A63B 22/001 482/52 |
| 2008/0167165 | A1 * | 7/2008 | Liao | A63B 22/001 482/52 |
| 2009/0239714 | A1 * | 9/2009 | Sellers | A63B 22/001 482/52 |
| 2011/0028277 | A1 * | 2/2011 | Merli | A63B 23/03575 482/63 |
| 2012/0277066 | A1 * | 11/2012 | Hsu | A63B 22/001 482/57 |
| 2014/0243157 | A1 * | 8/2014 | Huang | A63B 22/001 482/52 |

* cited by examiner

SITTING TYPE OBLONG ORBITAL EXERCISING MACHINE

BACKGROUND OF THE INVENTION

1. Field of the Invention

The present invention relates to an exercising machine and, more particularly, to a sitting type exercising machine with an oblong orbit or cycle.

2. Description of the Related Art

A conventional sitting type oblong orbital exercising machine comprises a main frame, two swinging handles, a seat, two pedals and a linkage. When a user is seated on the seat, his/her hands hold the swinging handles and his/her feet tread the pedals to perform an oblong movement trace.

However, when each of the pedals is moved to the front portion of the main frame, the front part of the user's one foot extends forward to abut the front part of each of the pedals, thereby easily causing an uncomfortable sensation to the user when each of the pedals changes the position quickly. In addition, the movement trace of the conventional sitting type oblong orbital exercising machine is fixed and cannot be adjusted, thereby limiting the versatility of the conventional sitting type oblong orbital exercising machine.

BRIEF SUMMARY OF THE INVENTION

In accordance with the present invention, there is provided an oblong orbital exercising machine comprising a main frame, an upright mounted on a front portion of the main frame, a seat support mounted on a rear portion of the main frame, a cycle movement mechanism mounted on the main frame, a slide rail mounted on the seat support, a seat slidably mounted on the slide rail, two guiding tracks mounted on the main frame, two swinging handles pivotally mounted on the upright, two drive bars each having a first end pivotally connected with the cycle movement mechanism, two pedal units each mounted on a second end of one of the two drive bars, two driven bars each having a first end pivotally connected with one of the two swinging handles and a second end pivotally connected with one of the two drive bars, and two rollers each pivotally connected with the second end of one of the two driven bars and each movably mounted in one of the two guiding tracks. Each of the pedal units includes a fixing plate secured on the second end of the respective drive bar and provided with two elongate slots, a rocking plate pivotally connected with the second end of the respective drive bar, two springs biased between the fixing plate and the rocking plate, two fastening rods secured on the rocking plate and extending through the springs and the elongate slots of the fixing plate, and a pedal secured on the rocking plate. The fixing plate of each of the pedal units is perpendicular to the respective drive bar.

The oblong orbital exercising machine further comprises two adjustment units each mounted between the first end of one of the two drive bars and the cycle movement mechanism. Each of the two adjustment units includes a fixed disk mounted on the cycle movement mechanism and provided with a plurality of adjusting holes, an adjusting disk juxtaposed to the fixed disk and provided with two arcuate slots, two limit stubs secured on the fixed disk and received in the two arcuate slots of the adjusting disk, a hollow rod mounted on the adjusting disk, a hollow mounting sleeve secured on the first end of the respective drive bar and pivotally mounted on the hollow rod, and a positioning pull pin extending through the hollow rod and extending into one of the adjusting holes of the fixed disk so that the adjusting disk and the fixed disk are positioned mutually. When the adjusting disk of each of the two adjustment units is rotatable relative to the fixed disk, the two limit stubs of each of the two adjustment units are slidable in the two arcuate slots of the adjusting disk. Each of the two opposite sides of the cycle movement mechanism has an eccentric position provided with an axle. The fixed disk of each of the two adjustment units is secured on the respective axle of the cycle movement mechanism. The hollow rod of each of the two adjustment units is located at an eccentric position of the adjusting disk and extends through the adjusting disk.

According to the primary advantage of the present invention, the springs of each of the pedal units provide an elastic force to the pedal, so that when the pedal units are moved in concert with the drive bars to perform an oblong orbital movement, the pedal of each of the pedal units is moved and adjusted forward and backward to correspond to the oblong trace of movement.

According to another advantage of the present invention, the orientation of the pedal of each of the pedal units satisfies an ergonomically designed requirement, so that when the pedal of each of the pedal units is moved to the foremost position, the user's feet can tread the pedal of each of the pedal units exactly and comfortably.

According to a further advantage of the present invention, the hollow rod, the hollow mounting sleeve and the positioning pull pin of each of the two adjustment units construct a common axis, so that when the user needs to rotate the adjusting disk, the user only needs to pull the positioning pull pin and to move the hollow mounting sleeve so as to rotate the adjusting disk for adjusting the positions of each of the pedal units, such that the user can adjust the positions of each of the pedal units easily and quickly.

According to a further advantage of the present invention, rotation of the adjusting disk is limited by the two limit stubs of each of the two adjustment units so that the adjusting disk will not be rotated to an excessive extent, thereby preventing the adjusting disk from being vibrated, and thereby facilitating the user adjusting the positions of each of the pedal units.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
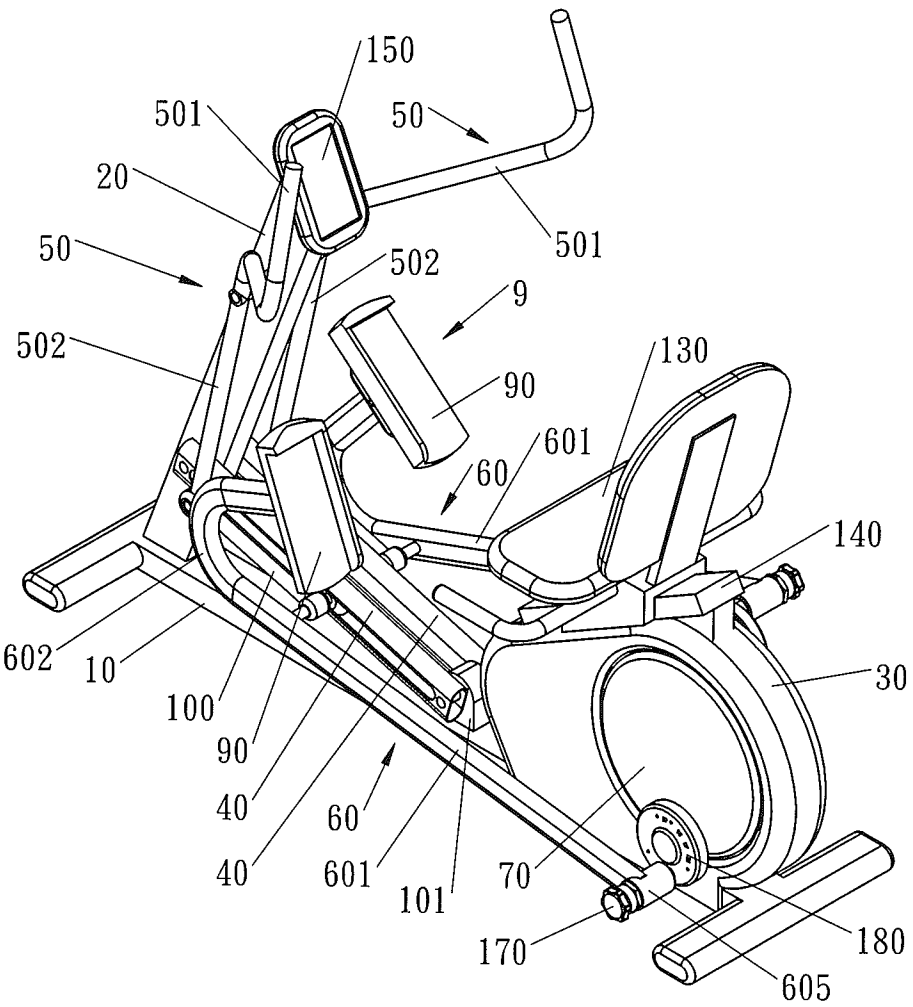
FIG. 1 is a perspective view of an oblong orbital exercising machine in accordance with the preferred embodiment of the present invention.
Figure 2:
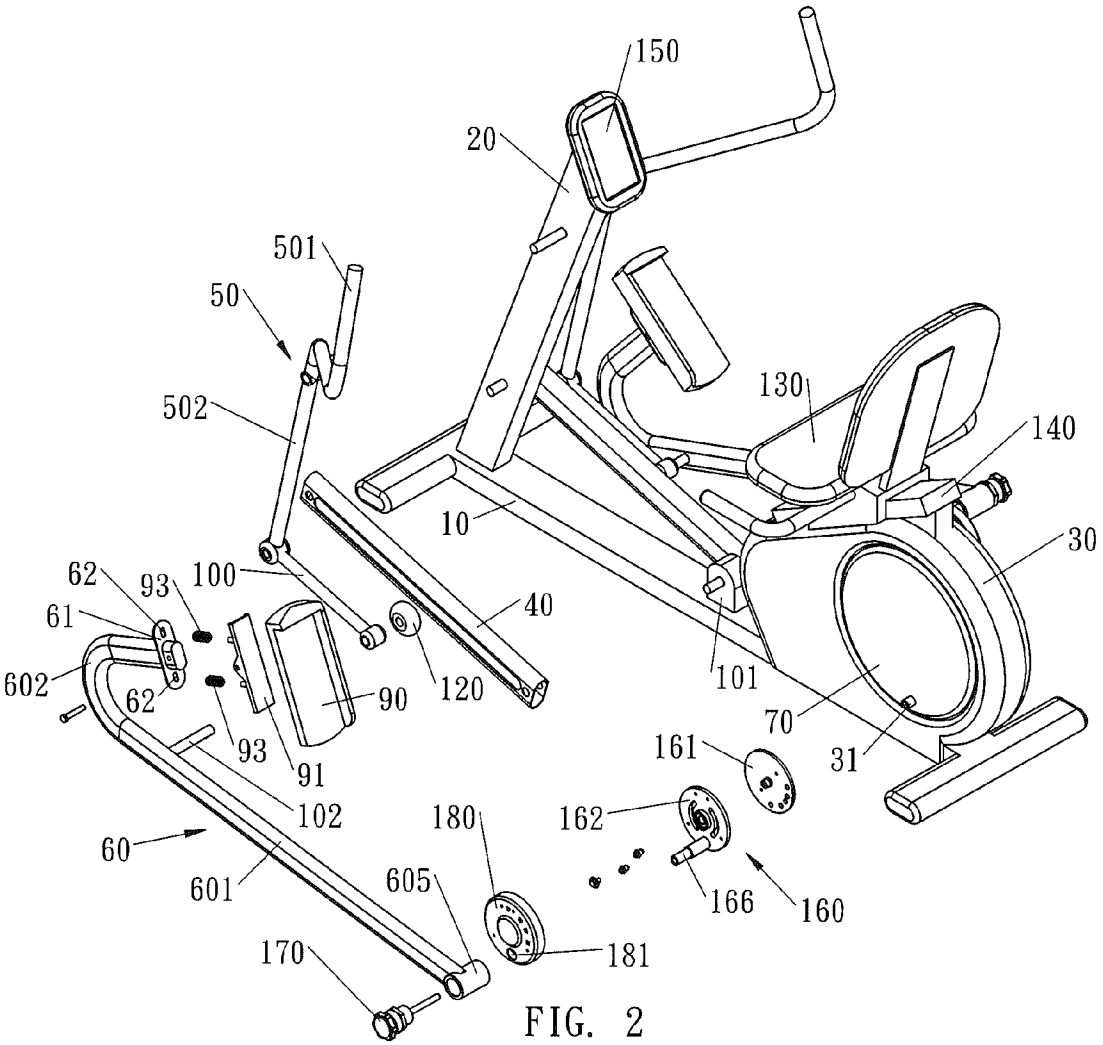
FIG. 2 is an exploded perspective view of the oblong orbital exercising machine as shown in FIG. 1.
Figure 3:
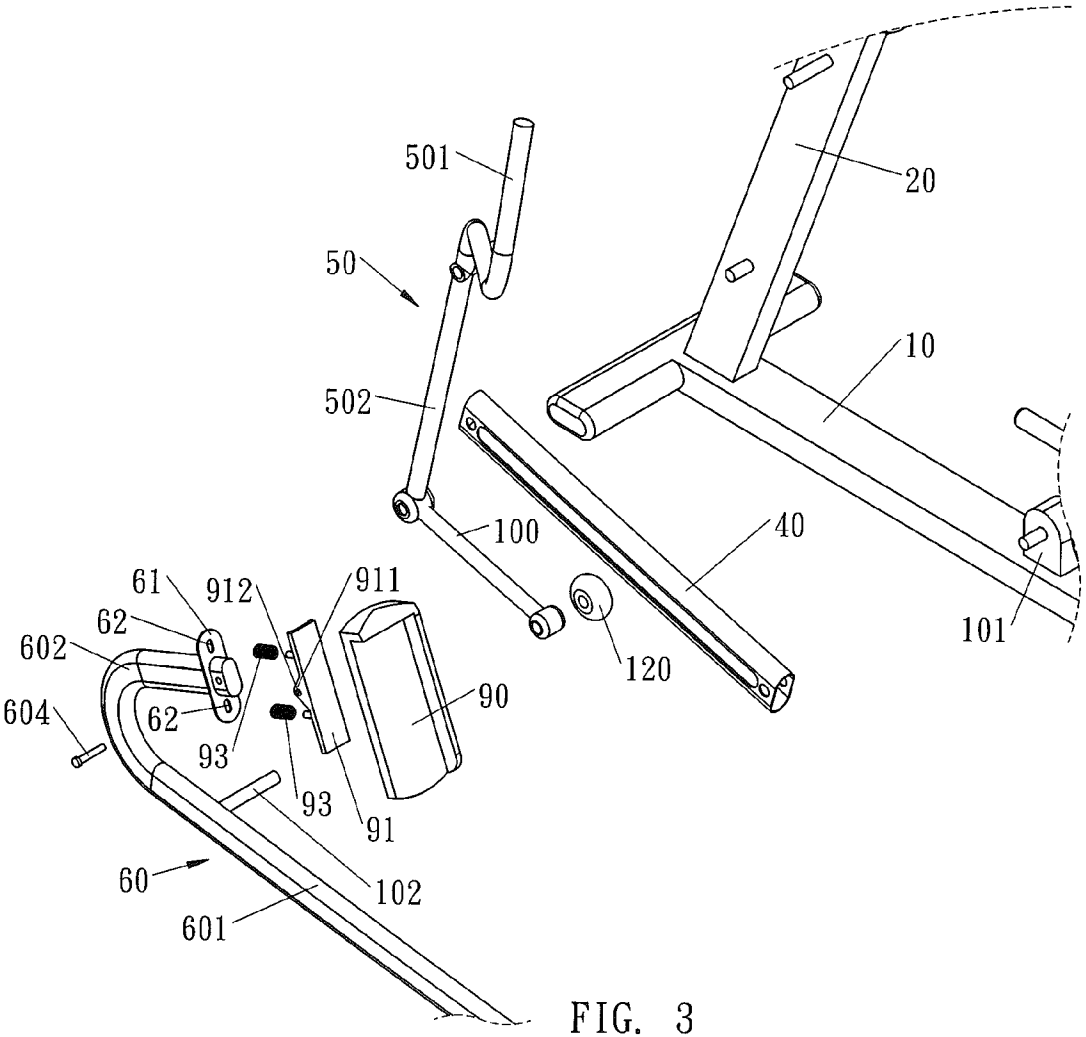
FIG. 3 is a locally enlarged view of the oblong orbital exercising machine as shown in FIG. 2.
Figure 4:
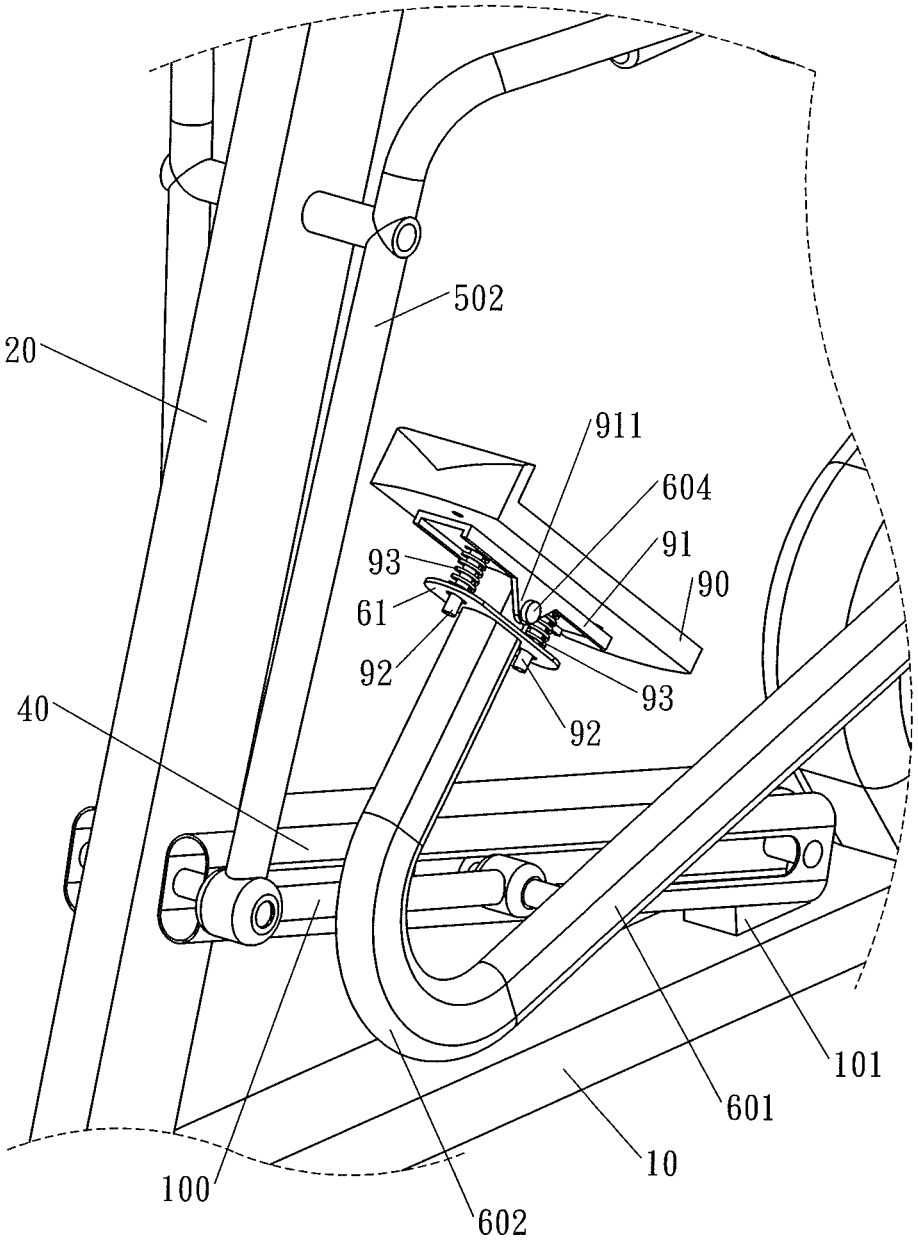
FIG. 4 is a locally enlarged perspective view of the oblong orbital exercising machine as shown in FIG. 1.
Figure 5:
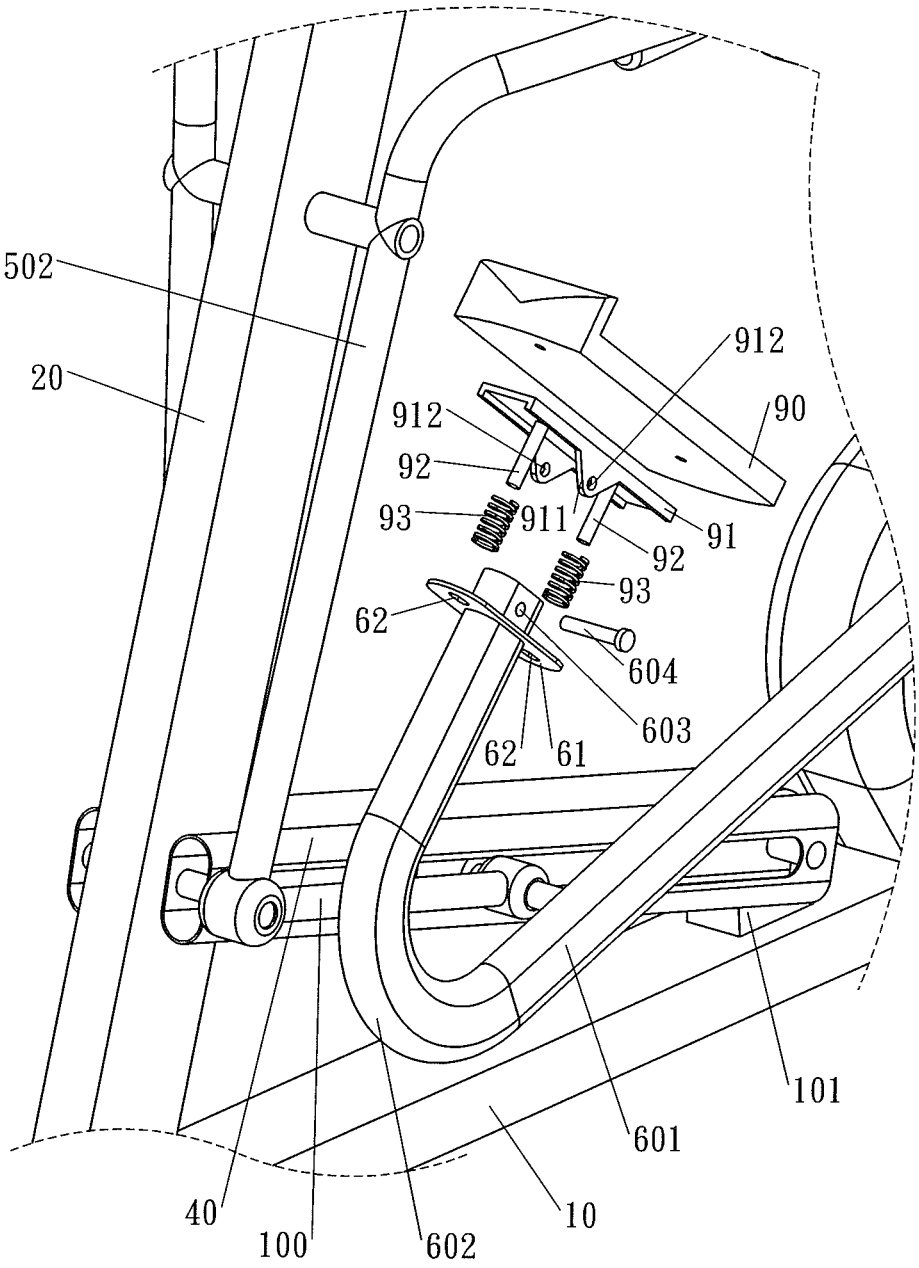
FIG. 5 is a partially exploded perspective view of the oblong orbital exercising machine as shown in FIG. 4.

Referring to the drawings and initially to FIGS. 1-6, an oblong orbital exercising machine in accordance with the preferred embodiment of the present invention comprises a main frame 10, an upright 20 mounted on a front portion of the main frame 10, a seat support 30 mounted on a rear portion of the main frame 10, a cycle movement mechanism 70 mounted on the main frame 10 and located between the seat support 30 and the main frame 10, a slide rail 140 mounted on the seat support 30, a seat 130 slidably mounted on the slide rail 140, two guiding tracks 40 mounted on the main frame 10, two swinging handles 50 pivotally mounted on the upright 20, two drive bars 60 each having a first end pivotally connected with the cycle movement mechanism 70, two pedal units 9 each mounted on a second end of one of the two drive bars 60, two driven bars 100 each having a first end pivotally connected with one of the two swinging handles 50 and a second end pivotally connected with one of the two drive bars 60, and two rollers 120 each pivotally connected with the second end of one of the two driven bars 100 and each movably mounted in one of the two guiding tracks 40.

The main frame 10 is provided with a fixing base 101. The upright 20 has an upper end provided with an instrument panel 150. The guiding tracks 40 are arranged on the main frame 10 in an inclined manner. Each of the guiding tracks 40 has a substantially C-shaped cross-sectional profile and has a first end secured on the upright 20 and a second end secured on the fixing base 101 of the main frame 10. The swinging handles 50 are arranged on two opposite sides of the upright 20. Each of the swinging handles 50 includes an upper grip portion 501 and a lower elastic portion 502 connected with the upper grip portion 501. The lower elastic portion 502 of each of the swinging handles 50 is flexible relative to the upper grip portion 501. The drive bars 60 are arranged on two opposite sides of the cycle movement mechanism 70. Each of the drive bars 60 includes a straight section 601 and a curved section 602. The curved section 602 of each of the drive bars 60 has a substantially U-shaped profile. The second end of each of the drive bars 60 is provided with a through hole 603 (see FIG. 5). The first end of each of the driven bars 100 is pivotally connected with the lower end of the lower elastic portion 502 of the respective swinging handle 50. The second end of each of the driven bars 100 is pivotally connected with the straight section 601 of the respective drive bar 60. The second end of each of the driven bars 100 is provided with a transverse connecting rod 102 which is connected with the respective roller 120 and the respective drive bar 60.

Each of the pedal units 9 is pivotally connected with the curved section 602 of the respective drive bar 60. Each of the pedal units 9 includes a fixing plate 61 secured on the second end of the respective drive bar 60 and provided with two elongate slots 62, a rocking plate 91 pivotally connected with the second end of the respective drive bar 60, two springs 93 biased between the fixing plate 61 and the rocking plate 91, two fastening rods 92 secured on the rocking plate 91 and extending through the springs 93 and the elongate slots 62 of the fixing plate 61, and a pedal 90 secured on the rocking plate 91.

The fixing plate 61 of each of the pedal units 9 is secured on the curved section 602 of the respective drive bar 60 and is perpendicular to the respective drive bar 60. The fixing plate 61 of each of the pedal units 9 is inclined relative to the ground, and an angle between the fixing plate 61 of each of the pedal units 9 and the ground is ranged between 55° and 75°. The rocking plate 91 of each of the pedal units 9 is provided with two pivot ears 911 mounted on the second end of the respective drive bar 60. Each of the pivot ears 911 of each of the pedal units 9 is provided with a through bore 912, and each of the pedal units 9 further includes a pivot member 604 extending through the through bore 912 of each of the pivot ears 911 and the through hole 603 of the respective drive bar 60, so that the pivot ears 911 of each of the pedal units 9 is pivotally connected with the second end of the respective drive bar 60.

Figure 6:
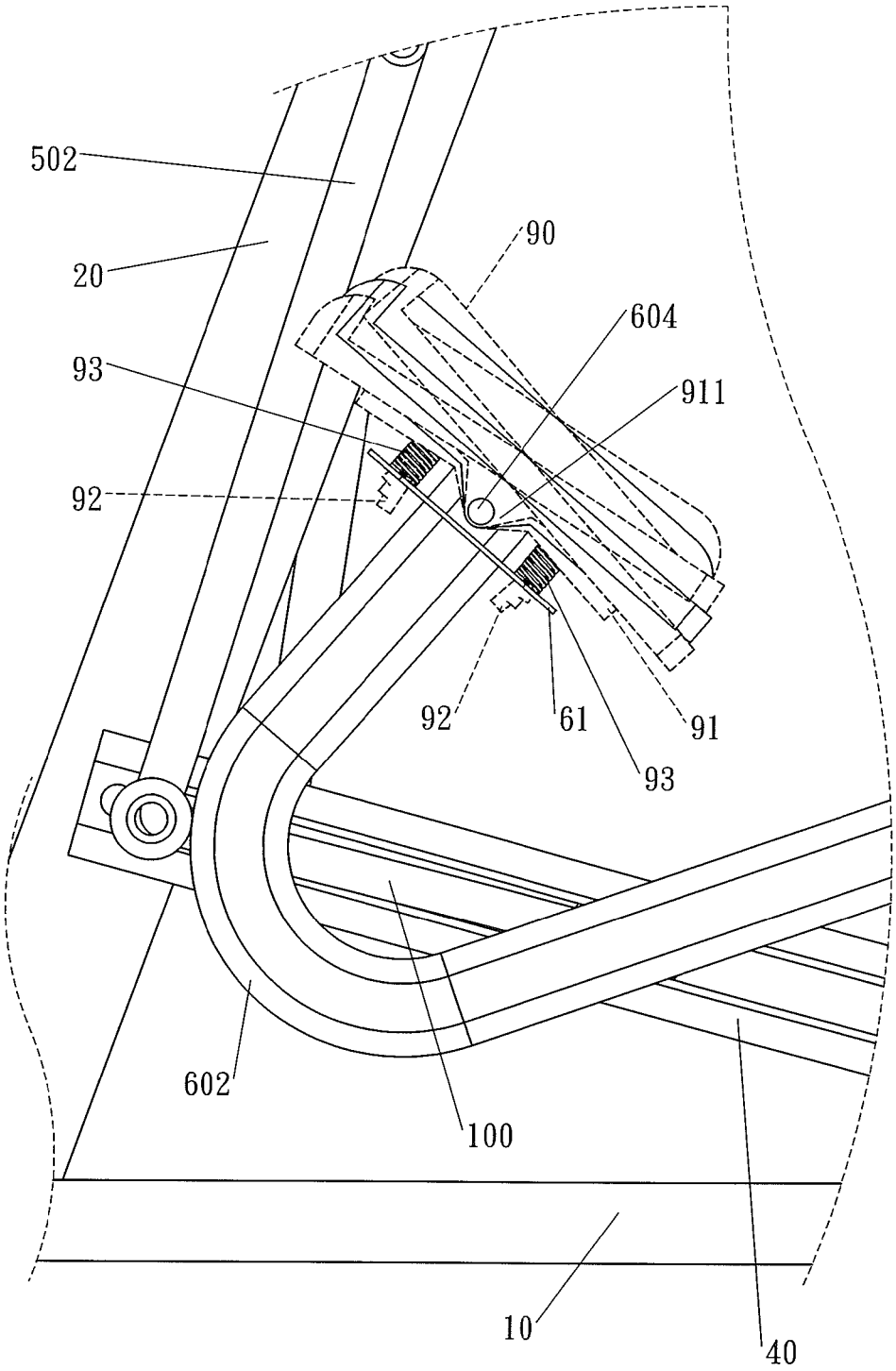
FIG. 6 is a front operational view of the oblong orbital exercising machine as shown in FIG. 4.

In operation, referring to FIG. 6 with reference to FIGS. 1-5, a user (not shown) is seated on the seat 130, with his/her hands holding and moving the upper grip portions 501 of the swinging handles 50, and with his/her feet treading the pedals 90 of the pedal units 9, so that the drive bars 60 and the driven bars 100 are driven and moved, and the rollers 120 are driven synchronously to slide in the guiding tracks 40 forward and backward. At the same time, the drive bars 60 drive the cycle movement mechanism 70 to rotate so that the drive bars 60 are moved reciprocally, and the pedal units 9 are moved in concert with the drive bars 60 to perform a swinging movement with an oblong orbit or cycle. In addition, when the pedal units 9 are moved in concert with the drive bars 60, the pedal 90 of each of the pedal units 9 is pivoted relative to the curved section 602 of the respective drive bar 60 as shown in FIG. 6, and the springs 93 of each of the pedal units 9 are biased between the fixing plate 61 and the rocking plate 91 to provide a buffering effect to the pedal 90.

Referring to FIGS. 7-12 with reference to FIGS. 1-6, the oblong orbital exercising machine in accordance with the preferred embodiment of the present invention further comprises two adjustment units 160 each mounted between the first end of one of the two drive bars 60 and the cycle movement mechanism 70.

Each of the two adjustment units 160 includes a fixed disk 161 mounted on the cycle movement mechanism 70 and provided with a plurality of adjusting holes 163, an adjusting disk 162 juxtaposed to the fixed disk 161 and provided with two arcuate slots 165, two limit stubs 164 secured on the fixed disk 161 and received in the two arcuate slots 165 of the adjusting disk 162, a hollow rod 166 mounted on the adjusting disk 162, a hollow mounting sleeve 605 secured on the first end of the respective drive bar 60 and pivotally mounted on the hollow rod 166, and a positioning pull pin 170 extending through the hollow rod 166 and extending into one of the adjusting holes 163 of the fixed disk 161 so that the adjusting disk 162 and the fixed disk 161 are positioned mutually. When the adjusting disk 162 of each of the two adjustment units 160 is rotatable relative to the fixed disk 161, the two limit stubs 164 of each of the two adjustment units 160 are slidable in the two arcuate slots 165 of the adjusting disk 162.

Each of the two opposite sides of the cycle movement mechanism 70 has an eccentric position provided with an axle 31. The fixed disk 161 of each of the two adjustment units 160 is secured on the respective axle 31 of the cycle movement mechanism 70. The adjusting disk 162 of each of the two adjustment units 160 is rotatably mounted on the fixed disk 161. The hollow rod 166 of each of the two adjustment units 160 is located at an eccentric position of the adjusting disk 162 and extends through the adjusting disk 162. The positioning pull pin 170 of each of the two adjustment units 160 is movably mounted on the hollow mounting sleeve 605.

Each of the two adjustment units 160 further includes a dustproof cover 180 mounted between the adjusting disk 162 and the hollow mounting sleeve 605. The dustproof cover 180 of each of the two adjustment units 160 has a side provided with an indication scale and has an eccentric position provided with an aperture 181 to allow passage of the hollow rod 166 so that the dustproof cover 180 of each of the two adjustment units 160 is positioned on the adjusting disk 162.

Figure 7:
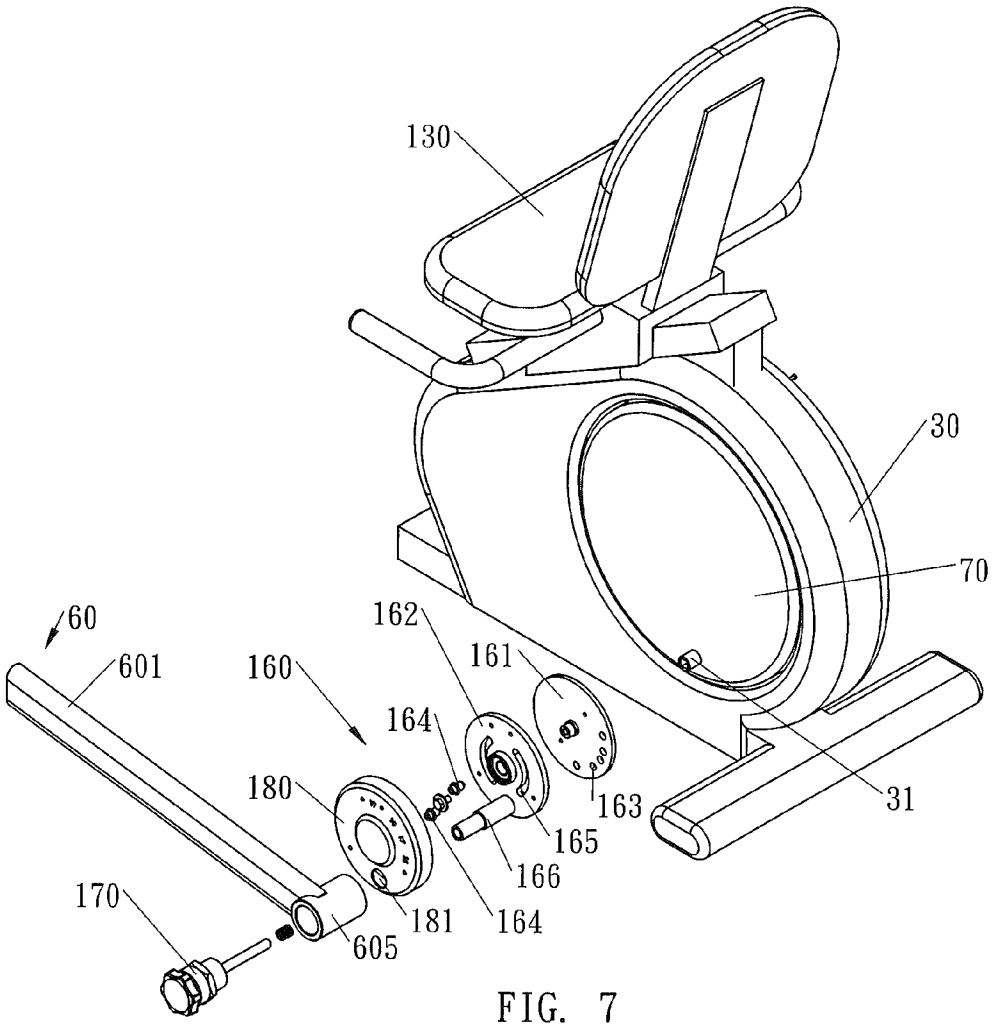
FIG. 7 is a partially exploded perspective view of the oblong orbital exercising machine as shown in FIG. 1.
Figure 8:
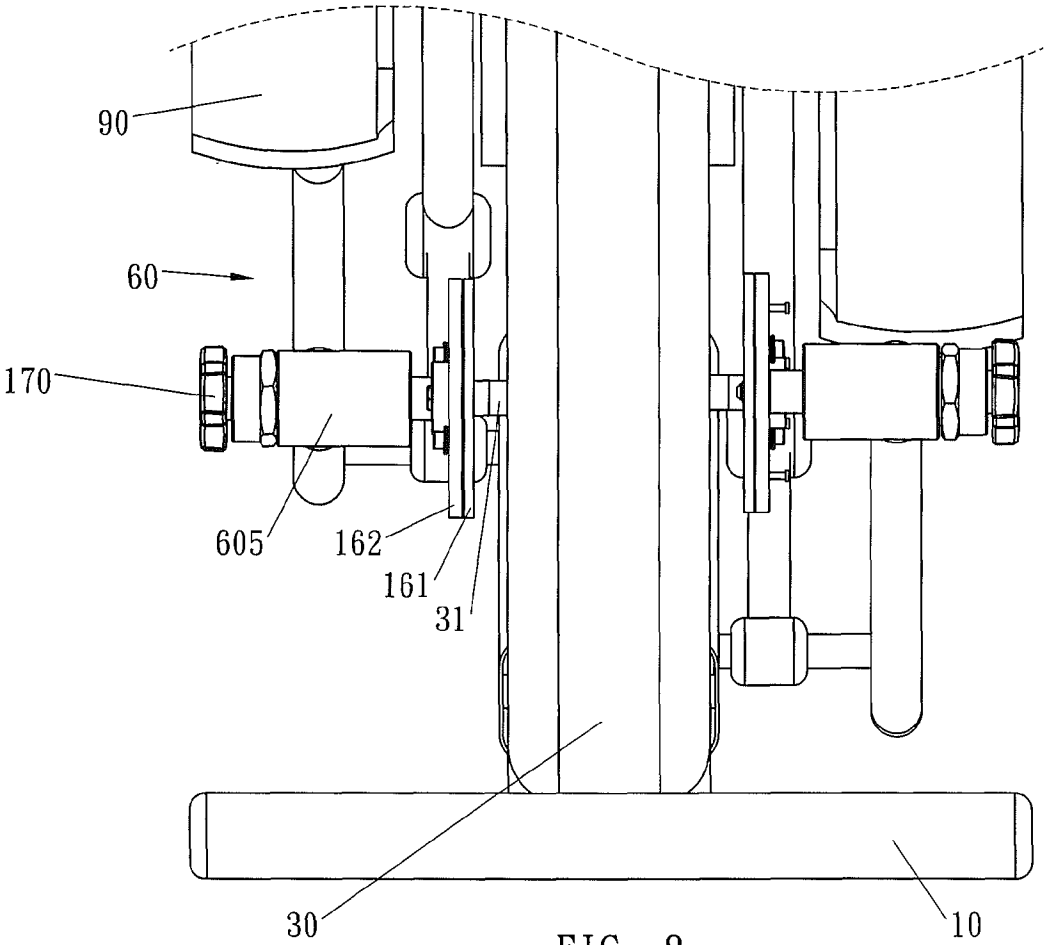
FIG. 8 is a locally enlarged side view of the oblong orbital exercising machine as shown in FIG. 1.
Figure 9:
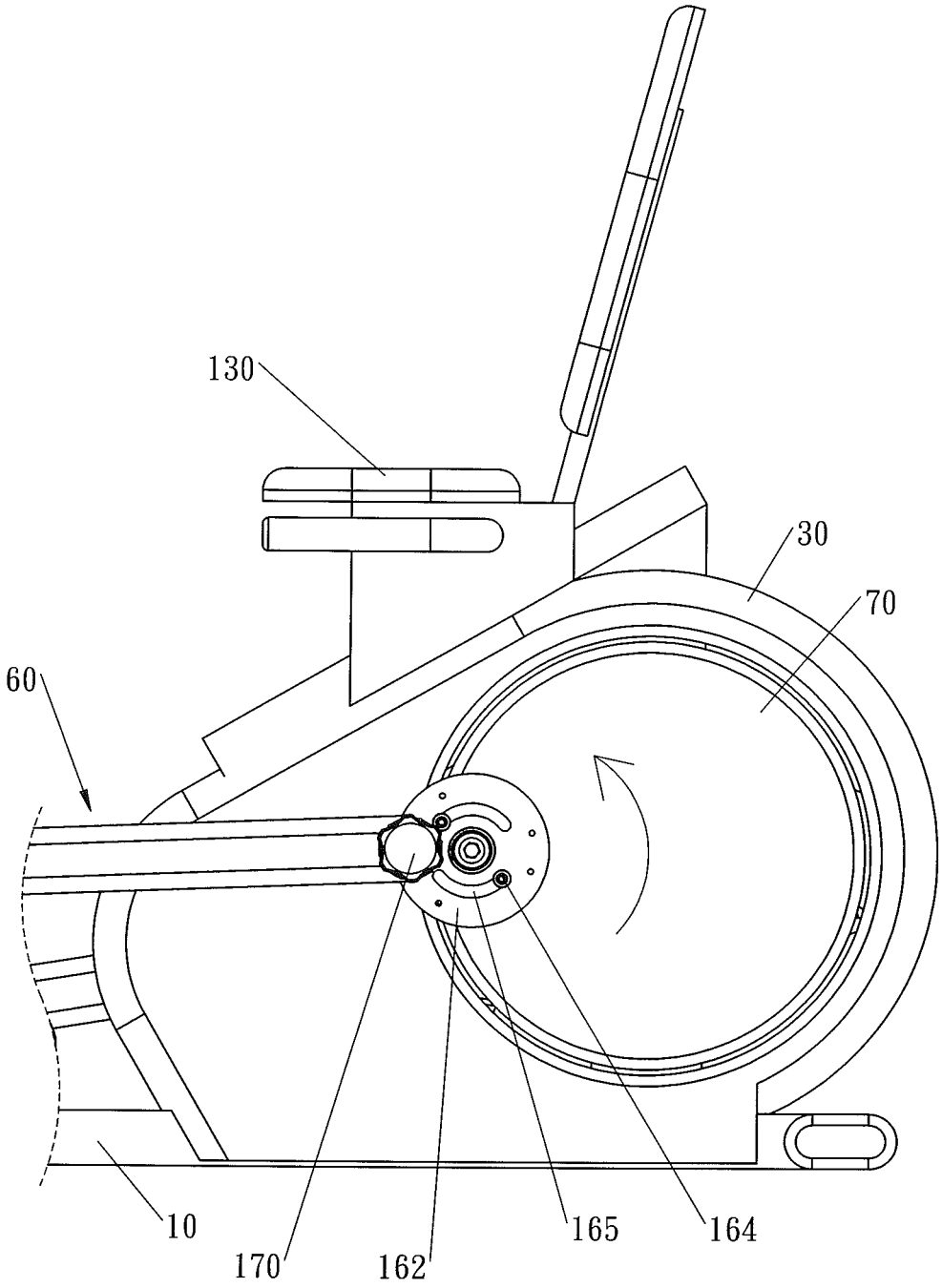
FIGS. 9-12 are locally enlarged front operational views showing adjustment of movement traces of the oblong orbital exercising machine as shown in FIG. 1.
Figure 10:
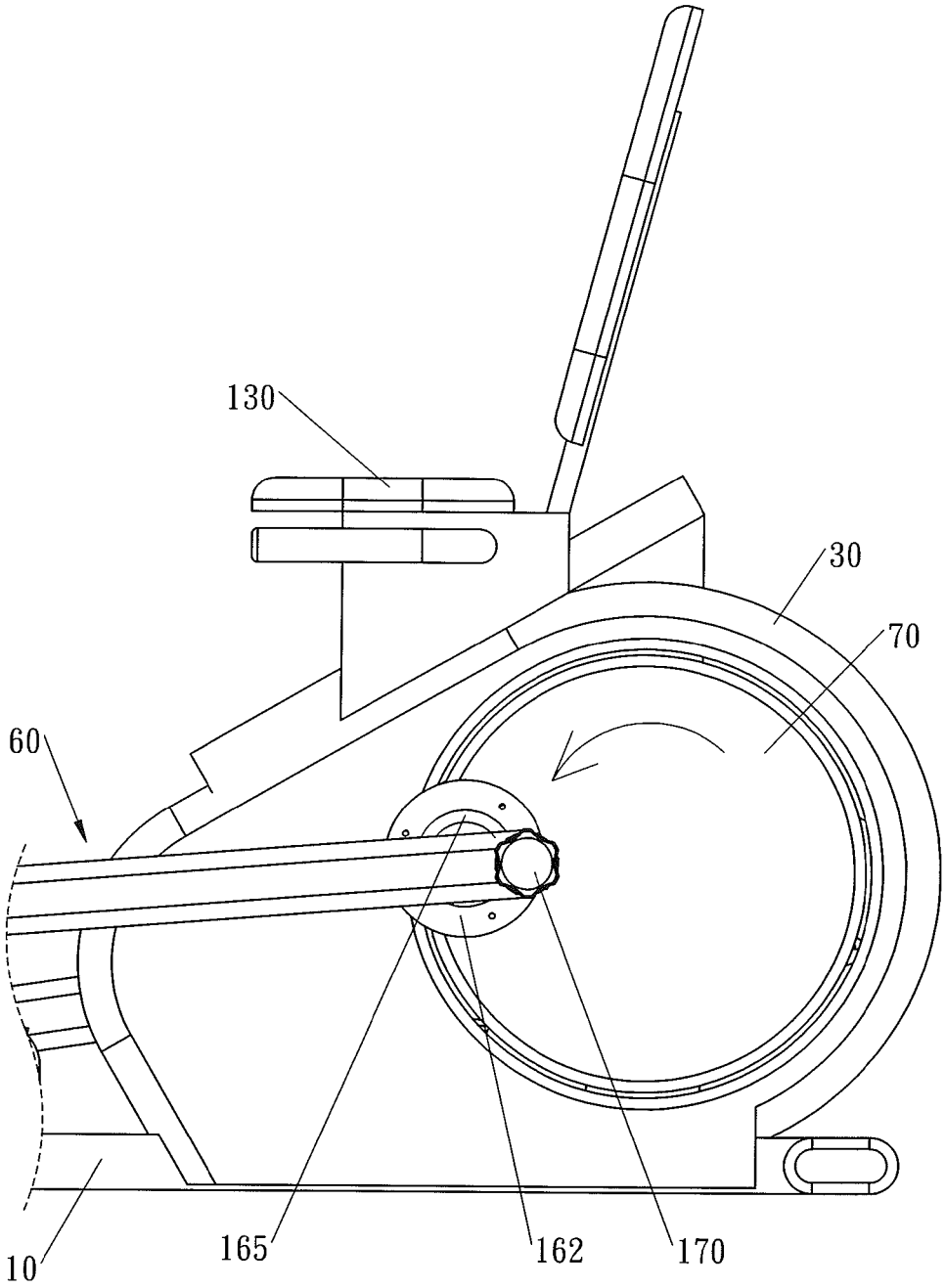
Figure 11:
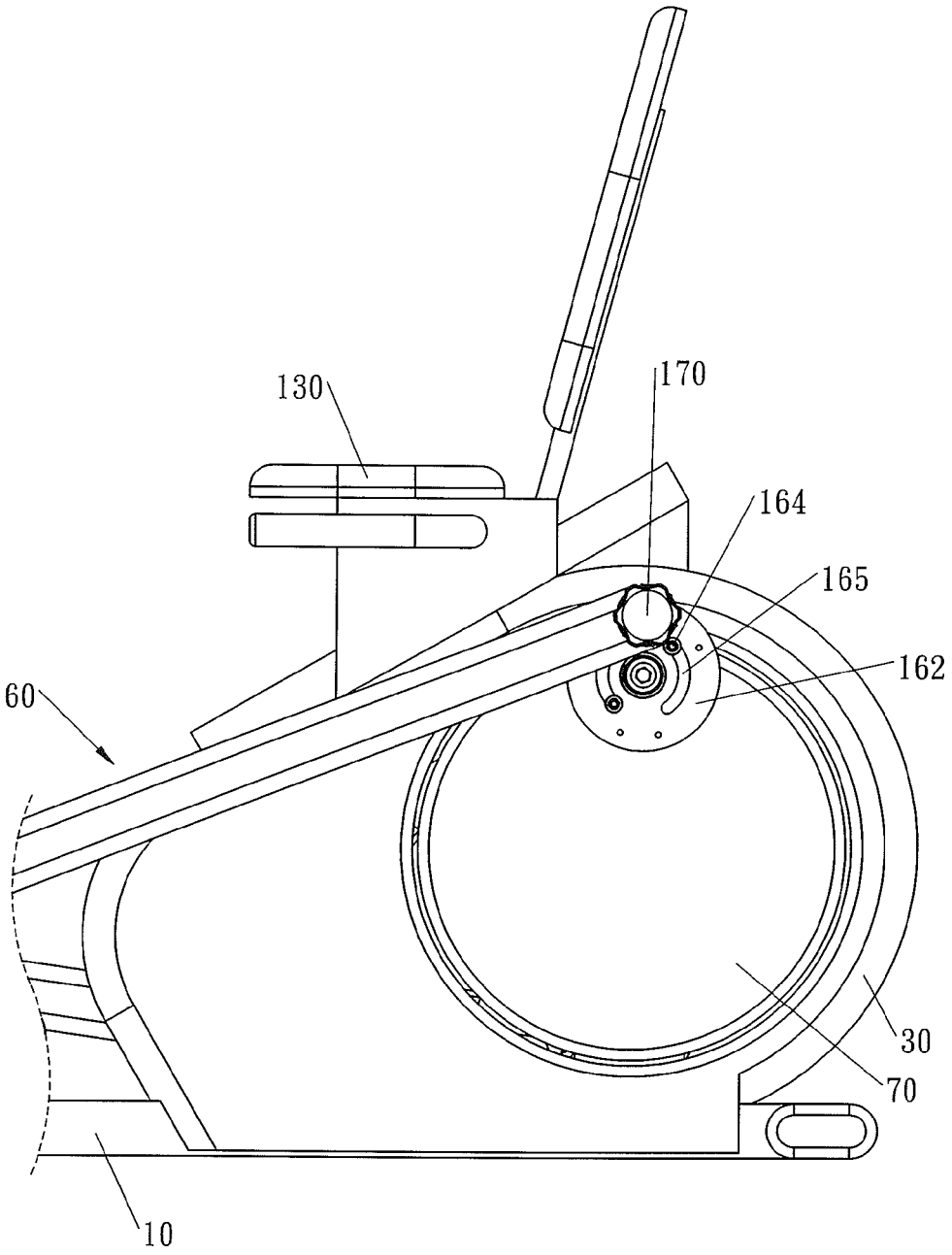
Figure 12:
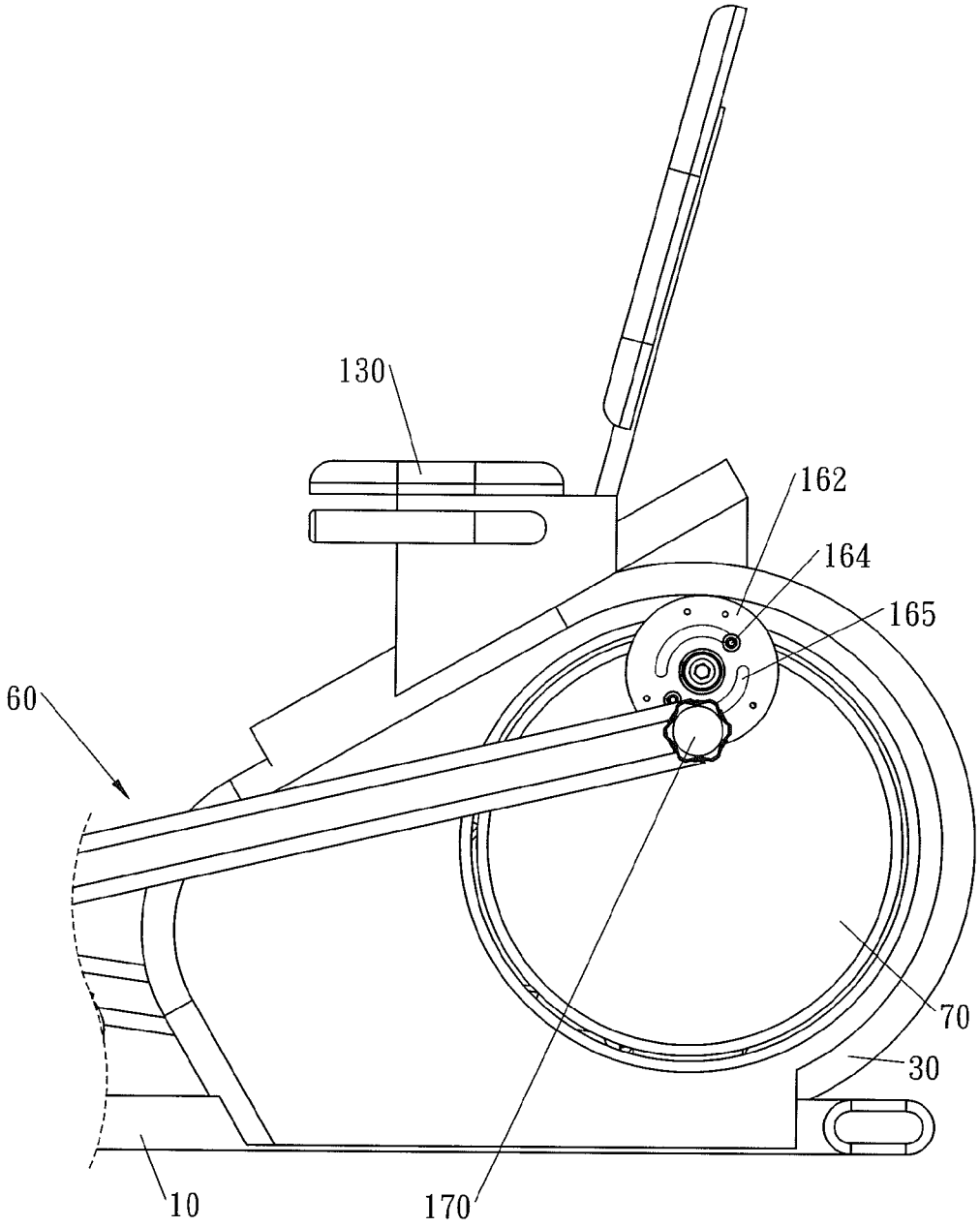

In adjustment, referring to FIGS. 9-12 with reference to FIGS. 7 and 8, when the positioning pull pin 170 of each of the two adjustment units 160 is pulled outward to detach from one of the adjusting holes 163 of the fixed disk 161, the adjusting disk 162 is unlocked from the fixed disk 161 so that the adjusting disk 162 can be rotated relative to the fixed disk 161. At this time, the two limit stubs 164 of each of the two adjustment units 160 slide in the two arcuate slots 165 of the adjusting disk 162 when the adjusting disk 162 is rotated relative to the fixed disk 161. When the positioning pull pin 170 of each of the two adjustment units 160 is pushed inward and locked into another one of the adjusting holes 163 of the fixed disk 161, the adjusting disk 162 is locked onto the fixed disk 161 again so that the adjusting disk 162 cannot be rotated relative to the fixed disk 161 ant more. Thus, the movement track of each of the two drive bars 60 is adjusted forward as shown in FIG. 9, backward as shown in FIG. 10, upward as shown in FIG. 11, and downward as shown in FIG. 12, so as to adjust different positions of each of the pedal units 9 and to adjust different movement traces of the exercising machine according to the user's requirement.

Accordingly, the springs 93 of each of the pedal units 9 provide an elastic force to the pedal 90, so that when the pedal units 9 are moved in concert with the drive bars 60 to perform an oblong orbital movement, the pedal 90 of each of the pedal units 9 is moved and adjusted forward and backward to correspond to the oblong trace of movement. In addition, the optimum angle between the fixing plate 61 of each of the pedal units 9 and the ground is ranged between 55° and 75° to satisfy the ergonomically designed requirement, so that when the pedal 90 of each of the pedal units 9 is moved to the foremost position, the user's feet can tread the pedal 90 of each of the pedal units 9 exactly and comfortably. Further, the fastening rods 92 are slidable in the elongate slots 62 of the fixing plate 61 to increase the swinging movement extent of the pedal 90, so that the pedal 90 of each of the pedal units 9 is pivoted largely relative to the fixing plate 61 to facilitate the user treading and swinging the pedal 90 of each of the pedal units 9. Further, the hollow rod 166, the hollow mounting sleeve 605 and the positioning pull pin 170 of each of the two adjustment units 160 construct a common axis, so that when the user needs to rotate the adjusting disk 162, the user only needs to pull the positioning pull pin 170 and to move the hollow mounting sleeve 605 so as to rotate the adjusting disk 162 for adjusting the positions of each of the pedal units 9, such that the user can adjust the positions of each of the pedal units 9 easily and quickly. Further, rotation of the adjusting disk 162 is limited by the two limit stubs 164 of each of the two adjustment units 160 so that the adjusting disk 162 will not be rotated to an excessive extent, thereby preventing the adjusting disk 162 from being vibrated, and thereby facilitating the user adjusting the positions of each of the pedal units 9. Further, the dustproof cover 180 of each of the two adjustment units 160 covers and provides a dustproof function to the fixed disk 161 and the adjusting disk 162, thereby enhancing the lifetime of the fixed disk 161 and the adjusting disk 162. Further, the adjusting disk 162 of each of the two adjustment units 160 is covered by the dustproof cover 180, thereby preventing the user from being scratched or hurt during rotation of the adjusting disk 162.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An oblong orbital exercising machine comprising:

a main frame;

an upright mounted on a front portion of the main frame;

a seat support mounted on a rear portion of the main frame;

a cycle movement mechanism mounted on the main frame;

a slide rail mounted on the seat support;

a seat slidably mounted on the slide rail;

two guiding tracks mounted on the main frame;

two swinging handles pivotally mounted on the upright;

two drive bars each having a first end pivotally connected with the cycle movement mechanism;

two pedal units each mounted on a second end of one of the two drive bars;

two driven bars each having a first end pivotally connected with one of the two swinging handles and a second end pivotally connected with one of the two drive bars; and two rollers each pivotally connected with the second end of one of the two driven bars and each movably mounted in one of the two guiding tracks;

wherein:

each of the pedal units includes:

a fixing plate secured on the second end of the respective drive bar and provided with two elongate slots;

a rocking plate pivotally connected with the second end of the respective drive bar;

two springs biased between the fixing plate and the rocking plate;

two fastening rods secured on the rocking plate and extending through the springs and the elongate slots of the fixing plate; and a pedal secured on the rocking plate; and the fixing plate of each of the pedal units is perpendicular to the respective drive bar.

2. The oblong orbital exercising machine of claim 1, wherein:

each of the drive bars includes a straight section and a curved section;

the second end of each of the driven bars is pivotally connected with the straight section of the respective drive bar;

the curved section of each of the drive bars has a substantially U-shaped profile; and each of the pedal units is pivotally connected with the curved section of the respective drive bar.

3. The oblong orbital exercising machine of claim 1, wherein:

the second end of each of the drive bars is provided with a through hole;

the rocking plate of each of the pedal units is provided with two pivot ears mounted on the second end of the respective drive bar;

each of the pivot ears of each of the pedal units is provided with a through bore; and each of the pedal units further includes a pivot member extending through the through bore of each of the pivot ears and the through hole of the respective drive bar.

4. The oblong orbital exercising machine of claim 1, wherein the fixing plate of each of the pedal units is inclined relative to the ground, and an angle between the fixing plate of each of the pedal units and the ground is ranged between 55° and 75°.

5. The oblong orbital exercising machine of claim 1, further comprising:

two adjustment units each mounted between the first end of one of the two drive bars and the cycle movement mechanism;

wherein:

each of the two adjustment units includes:

a fixed disk mounted on the cycle movement mechanism and provided with a plurality of adjusting holes;

an adjusting disk juxtaposed to the fixed disk and provided with two arcuate slots;

two limit stubs secured on the fixed disk and received in the two arcuate slots of the adjusting disk;

a hollow rod mounted on the adjusting disk;

a hollow mounting sleeve secured on the first end of the respective drive bar and pivotally mounted on the hollow rod; and a positioning pull pin extending through the hollow rod and extending into one of the adjusting holes of the fixed disk so that the adjusting disk and the fixed disk are positioned mutually;

when the adjusting disk of each of the two adjustment units is rotatable relative to the fixed disk, the two limit stubs of each of the two adjustment units are slidable in the two arcuate slots of the adjusting disk;

each of the two opposite sides of the cycle movement mechanism has an eccentric position provided with an axle;

the fixed disk of each of the two adjustment units is secured on the respective axle of the cycle movement mechanism; and the hollow rod of each of the two adjustment units is located at an eccentric position of the adjusting disk and extends through the adjusting disk.

6. The oblong orbital exercising machine of claim 5, wherein:

each of the two adjustment units further includes a dustproof cover mounted between the adjusting disk and the hollow mounting sleeve; and the dustproof cover of each of the two adjustment units has a side provided with an indication scale and has an eccentric position provided with an aperture to allow passage of the hollow rod so that the dustproof cover of each of the two adjustment units is positioned on the adjusting disk.

* * * * *